US005081466A

United States Patent [19]

Bitter, Jr.

[11] Patent Number: 5,081,466

[45] Date of Patent: Jan. 14, 1992

[54] TAPERED NOTCH ANTENNA

[75] Inventor: Charles R. Bitter, Jr., Scottsdale, Ariz.

[73] Assignee: Motorola, Inc., Schaumburg, Ill.

[21] Appl. No.: 518,047

[22] Filed: May 4, 1990

[51] Int. Cl.[5] ..... H01Q 1/38; H01Q 13/08

[52] U.S. Cl. ..... 343/767

[58] Field of Search ..... 343/767, 768, 700 MS File, 343/795, 772, 786

[56] References Cited

U.S. PATENT DOCUMENTS 4,843,403 6/1989 Lalezari et al. ..... 343/767

4,853,704 8/1989 Diaz et al. ..... 343/767

FOREIGN PATENT DOCUMENTS 257881 3/1988 European Pat. Off. .

3215323 7/1986 Fed. Rep. of Germany ..... 343/768

*Primary Examiner*—Michael C. Wimer

*Attorney, Agent, or Firm*—Wayne J. Egan

[57] ABSTRACT

An improved tapered notch antenna configuration is provided. H-plane pattern directivity is achieved by splitting the planar tapered notch into two diverging surfaces to increase aperture dimension in that plane.

A first embodiement describes a stripline feed approach where the ground plane conductors and attendant dielectric substrates diverge in the notch taper region.

A second embodiment utilizes a conductor plane containing a notch and coplanar transmission line which is imbedded at half-depth within an essentially thin dielectric slab. The conductor plane and the dielectric slab separate into two equal but diverging conductive surfaces on separate dielectric substrates in the taper region.

The improved tapered notch antenna, according to the invention, provides increased H-plane directivity, while retaining the prior art-features of feed compactness, low-cost, and repeatability.

9 Claims, 2 Drawing Sheets

TAPERED NOTCH ANTENNA

TECHNICAL FIELD

This application relates to notch/slotline antennas.

BACKGROUND OF THE INVENTION

The present invention pertains to linearly polarized notch (i.e., slotline) antennas that are tapered outward toward the open end. As is known, an open-ended slot or notch radiator is a relatively broadband element especially when flared as a broadband transition to free space. It has important advantages which are desirable, such as being light in weight, cheaply manufactured with printed circuit board techniques that are capable of accurate replication from unit to unit.

Tapered notch antennas excited by a microstrip feedline are known in the art. Such a prior art antenna is shown in FIG. 1. There is shown a planar surface 101 such as a circuit board with a front side 103 and a back side 105. The front side 103 has a metallized surface 107 with a tapered notched area 111 etched away to expose a dielectric substrate 109. This area extends to the edge finalized as dimension A. The back side 105 comprises the dielectric substrate 109 with a metallized strip 113 affixed thereon. The metallized surface 107 forms a ground plane for the microstrip feed line 113.

As is known, the signal to be transmitted is applied to the strip 113 and coupled to the tapered notch 111 by means of the cross-over junction 115. The length $L_1$ of the open circuit stub 117 of the strip 113, and the length $L_2$ of the short circuited stub of the notch 111 are adjusted for optimum coupling at the junction 115. A notch antenna begins to radiate when the width of the notch as manifested by the taper becomes excessively wide. It is known that if the guide wavelength in the notch exceeds about 0.4 free space wavelength, then radiation results. The radiation may be controlled by the taper as a travelling wave outward toward the flared open end A. The dielectric helps confine the fields to within the region of the notch. At that point, nearly matched impedance conditions exist and launch of the field occurs with the E- and H-field components and the maximum radiation direction P as indicated. The wave polarization is parallel with the plane of the notch and the attendant taper. A phase center exists essentially at the center of the end of the flare A, and reciprocity holds for the system.

The radiation pattern in the E-plane has maximum directivity in the direction of P determined, in part, by the elecrical dimension of A. The H-plane radiation pattern has a very broad cardioid shape with a deep null in the direction of the shorted end of the notch and the maximum at the taper end in the direction of P.

One problem with the prior art arrangement, as in FIG. 1, is that it has low directivity in the H-plane. It is desirable, therefore, to provide an improved tapered notch antenna.

SUMMARY OF THE INVENTION

It is an object of the invention to provide an improved tapered notch antenna.

Therefore, an improved tapered notch antenna is provided. In a first embodiment, a stripline feed is used to implement a simple double conductive plane divergent tapered notch to yield twin phase centers useful for the increase of H-plane directivity.

In a second embodiment, a feed line structure is utilized that is a coplanar line, meaning that all conductors of the transmission line and the notch are in the same plane. As a result, this embodiment requires access to only one side of the printed circuit board for fabrication. This structure lends itself to simpler fabrication and to array techniques for increasing the H-plane directivity.

In a third embodiment, the directivity of the H-plane pattern directivity is increased by splitting the tapered region of the second embodiment into two or more conducting surfaces. The surfaces each contain the original tapered configuration and diverge outward away from one another in a controlled fashion, thereby forming an array in the H-plane of multiple phase centers of radiation. Due to the controlled divergence, the array has at the taper end of each diverging surface a controlled amplitude and phase, which combined yields an H-plane pattern shape and directivity beyond that of the single plane (single phase center) tapered notch element. In its simplest form, a single split, two surface, equal-taper element will have similarities to a twin dipole array of equivalent H-plane spacing.

DETAILED DESCRIPTION OF THE INVENTION

Figure 2A:
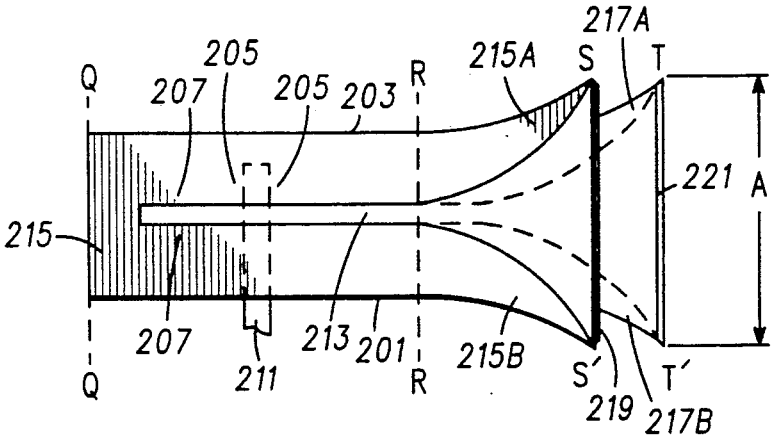
FIGS. 2A–2B show a first embodiment of a tapered notch antenna, according to the invention.

Referring now to FIG. 2A there is shown a side view of a first embodiment of a tapered notch antenna, according to the invention. There is shown an antenna that is formed by using a conventional stripline printed circuit board technique consisting of two thin dielectric substrates 219 and 221. The side 201 of substrate 219 has a metallic coating 215 disposed thereon. The other (inner) side of substrate 219 has a metallized strip 211 affixed thereon whose function is that of a conductive stripline track. On side 203 of the second substrate 221 a metallic coating 217 is disposed thereon. The other (inner) side of substrate 221 is unmetallized. The metallized surfaces 215 and 217 of substrates 219 and 221 respectively have identical portions of the metallic coating removed by etching to form a tapered notch depicted by 213 on the outer surfaces of both substrates, thus exposing the dielectric substrates 219 and 221. When the inner surfaces of substrates 219 and 221 are bonded together between line Q-Q and line R-R, the outer metallized surfaces 215 and 217 form the ground planes for the stripline feed whose conductive track is metallized strip 211 on the inner surface of substrate 219.

Figure 1:
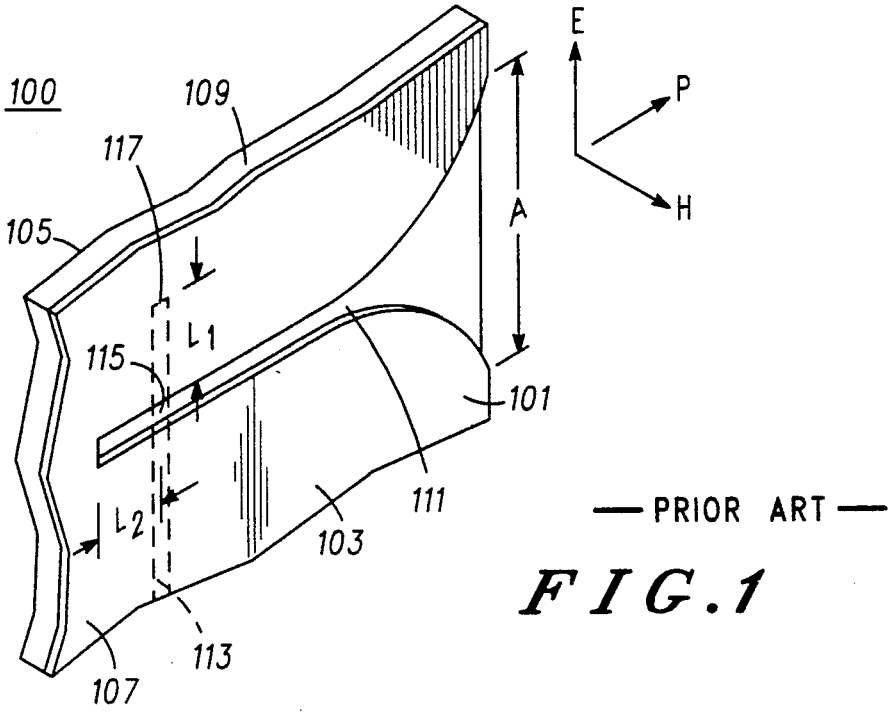
FIG. 1 shows a microstrip feed antenna, as in the prior art.
Figure 2B:
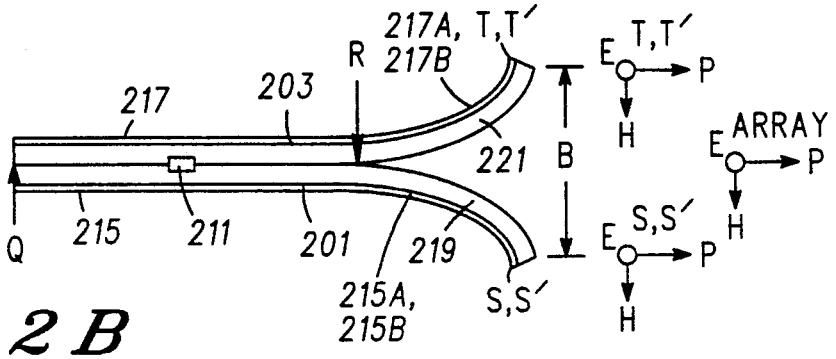

When a signal to be transmitted is applied to strip 211 it is coupled to the tapered notch of both metallized surfaces 215 and 217 just as in the microstrip version of FIG. 1. Reactive stubs 205 and 207 serve the same function as those of FIG. 1. The field in the stripline is thus coupled to the notches in 215 and 217 and travels outward toward R-R. The respective dielectric substrates tend to confine the respective portions of the field to the respective notch. At the point R-R the substrates diverge outward one from the other as shown in FIG. 2B. The travelling wave is equally divided at R-R and the respective portions of the field in the taper sections also diverge outward equally toward the taper end at S, S' and T, T'. Here coupling occurs as a space wave both at S, S' and T, T' each essentially acting as a separate phase center. Wave polarization of each phase center is parallel with the plane of the respective taper, with maximum radiation P as indicated in FIG. 2B. Reciprocity holds for the system. The two divergent tapered notch surfaces 215 and 217 thus result in two discrete apertures S, S' and T, T' similar to two dipoles, one oriented along the line S, S' and the other along line T, T', both fed in phase with equal amplitude and spaced the dimension B apart.

The spacing B gives an array factor to the H-plane directivity and is adjustable, thus enabling the width of the cardioid shape to be reduced. Maximum directivity of the array is in the direction of P, and the E and H field components are as indicated in FIG. 2B.

Figure 3:
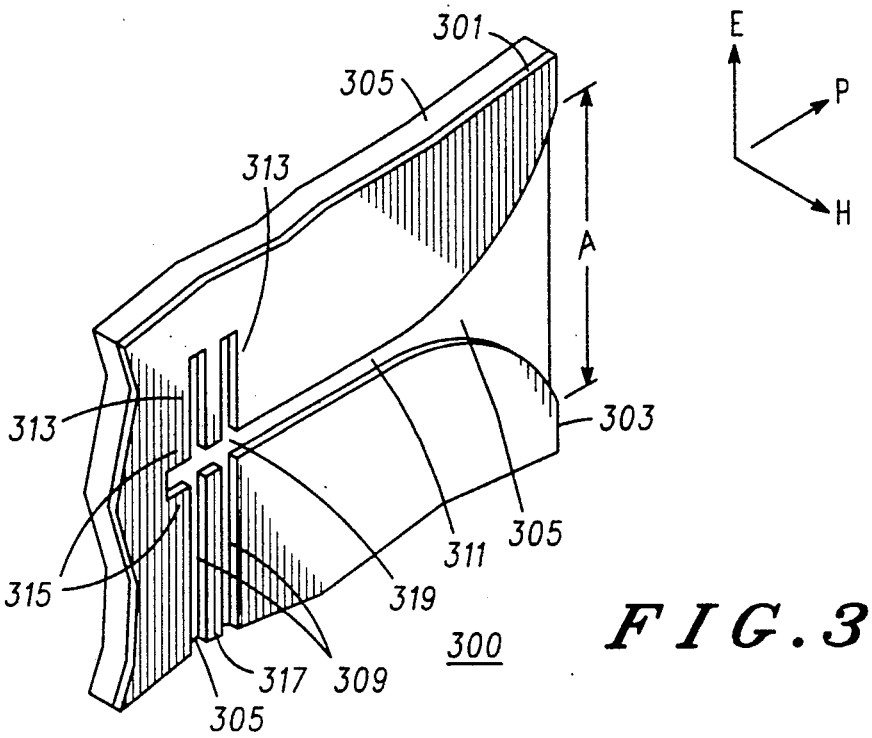
FIG. 3 shows a second embodiment of a tapered notch antenna, according to the invention.

Turning now to FIG. 3, there is shown a second embodiment of a tapered notch antenna, according to the invention. There is shown a planar dielectric surface 305 with a metallic coating 301 disposed thereon. The metallic coating has a portion removed by etching forming a tapered notch portion 307, notch portion 311 and a coplanar waveguide portion 309. A signal to be transmitted is applied to the coplanar waveguide between the center metallic strip 317 and the metallic coating 301. The coplanar waveguide field excitation is TEM in nature. The coplanar waveguide forms a cross junction 319. Shorted stub 313 of the coplanar waveguide extends beyond the notch and forms a reactance at the junction 319. The shorted stub 315 of the notch also forms a reactance at the junction 319, and can be adjusted to provide optimum field coupling one to the other, coplanar waveguide to notch. Hence, it is clear that once this adjustment is made and the field is excited in the notch 311, it propagates as a travelling wave outward along the notch slotline and taper 307 toward the board edge 303. The taper 307 provides an impedance transition from the slotline to the board edge aperture A where the travelling wave couples to space and radiation results outward normal to the edge in the direction of propagation P. The plane containing the notch is thus the E-plane, and the E and H field vectors are as labeled in FIG. 3.

The radiation pattern in the E-plane has a maximum directivity in the direction of P determined, in part, by the electrical dimension of A. The H-plane radiation pattern has a broad cardioid shape with the null in the direction of the shorted end of the notch and the maximum at the taper end in the direction of P. Reciprocity holds for the embodiment.

Figure 4A:
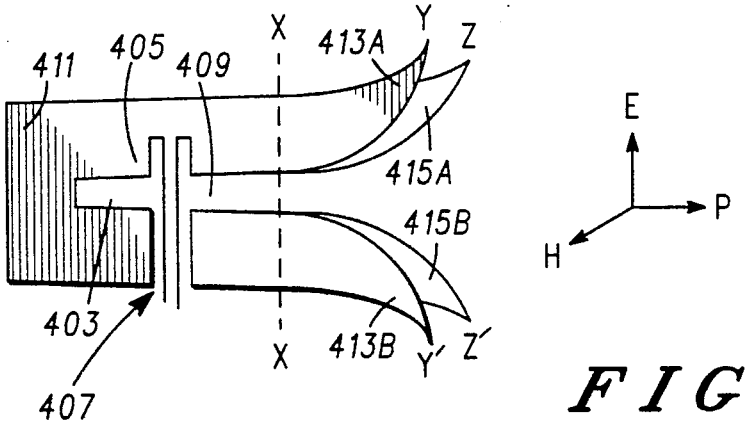
FIGS. 4A–4B show a third embodiment of a tapered notch antenna, according to the invention.

Referring now to FIG. 4A there is shown a side view of a third embodiment of a tapered notch antenna, according to the invention. Here the antenna element is formed of a thin metal plane 411 with thin dielectric substrates 417 and 419 on each side. The dielectric substrate boundaries are omitted for clarity in FIG. 4A. At the line X-X, the metal plate 411 is split into two identical planes 413 and 415 each with its dielectric substrate 417 or 419 at the line X-X. Hereafter, the notch area 409 diverges into two separate identical notches and tapered planes 413 and 415 with attendant dielectric substrates 417 and 419. As pictured in FIG. 4A, the tapered plane 413A with a tip designated Y and a lower portion 413B with a tip designated Y'. Similarly in FIG. 4A, the tapered plane 415 depicted as being farthest away from the viewer comprises an upper portion 415A with a tip designated Z and a lower portion 415B with a tip designated Z'.

Figure 4B:
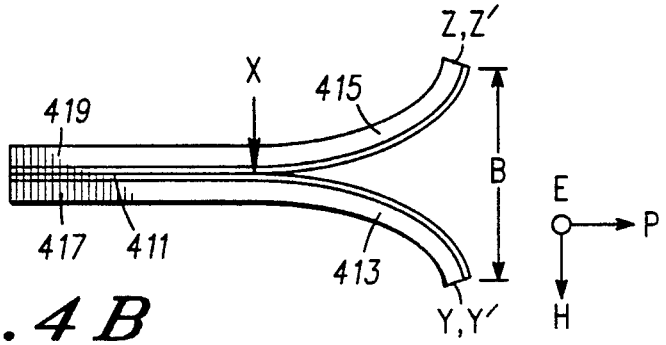

In FIG. 4B there is shown a top view of the third embodiment, indicating the boundaries of the dielectric substrates 417 and 419. As before, the metal plane 411 splits at the line X to become two curved planes 413 and 415, separated by a distance B at their tips.

In the third embodiment of FIGS. 4A and 4B, the feed 407 is a coplanar wave guide with cross junction to the notch 409 matched by reactive stubs 405 and 403. As shown, the split of the notch 409 into two tapered planes 413 and 415 results in discrete apertures Y-Y' and Z-Z' similar to two dipoles, one oriented along the line Y-Y' and the other along the line Z-Z'. Thus, when fed in phase these apertures Y-Y' and Z-Z' represent a two-element array of in-phase elements spaced apart by a distance B. This spacing gives H-plane pattern directivity control and may be adjusted as desired. Those skilled in the art will understand the possibilities for splitting the metal plane 411 into a multiplicity of separate planes at line X with their taper sections diverging outward one from another, each at a different rate such that a multiplicity of element end apertures is attained and so positioned as to form an array of discrete phase centers. Further, those skilled in the art will realize that both amplitude and phase of each phase center may be varied one to another by many conventional means, for example, by adjusting the taper path length, taper rate, impedance level, or by the use of separate and varied dielectric substrate materials.

While various embodiments of the tapered notch antenna, according to the invention, are disclosed hereinabove, the scope of the invention is defined by the following claims.

What is claimed is:

1. An antenna comprising:

a planar surface with metal coating disposed thereon, the metal coating removed in a first essentially linear region to form a stripline feed, the metal coating removed in a second region to form a notch having a closed narrow end and a relatively wider end that is open;

said stripline feed region intersecting said notch at a coplanar junction located near said narrow end of said stripline feed, the notch forming two metallic fingers that extend away from said coplanar junction and toward the open wider end;

wherein each of said two metallic fingers is split into two leaves, the leaves parted and separated relative to each other; and, wherein said leaves diverge outward from one another toward said open wider end.

2. The antenna of claim 1 wherein said planar surface forms one side of a printed circuit board.

3. An antenna comprising:

an essentially planar dielectric surface having an edge with a metal coating disposed thereon, the metal coating removed in a first essentially linear region on said surface to form a coplanar waveguide feed, the metal coating removed in a second region on said surface to form a notch having a closed narrow end and a tapered wider end that is open at the edge of the dielectric surface, the coplanar waveguide feed intersecting the notch at a coplanar junction located near the closed narrow end of the notch.

4. The antenna of claim 3 further arranged so that said tapered end of the notch is divided into two separate metallic surfaces, the metallic surfaces diverging away from one another toward the open end of the notch.

5. An antenna comprising:

a feed line and a notch radiator each formed as a conductor, said notch radiator having a closed narrow end, the other end having a wider tapered region that is open, said feed line and said notch radiator being coplanar, with the feed line and the notch radiator conductors in the same plane and disposed on a dielectric surface, said feed line coupled to said notch radiator by means of a coplanar junction located near the closed narrow end of the notch.

6. The antenna of claim 5, having said tapered region of said notch radiator separated into two conducting surfaces, the separated surfaces diverging outward away from one another towards the open end of the notch.

7. The antenna of claim 6 wherein said dielectric surface forms one side of a printed circuit board.

8. An antenna comprising:

two thin dielectric substrates, the first substrate having an outer side and an inner side, the outer side having a metallic surface disposed thereon, the inner side having a metallized strip affixed thereon whose function is that of a stripline, the second substrate having an outer side and an inner side, the outer side having a metallic surface disposed thereon, the inner side unmetallized, the metallized surfaces both having substantially identical portions of the metallic coating removed by etching to form a tapered notch on each surface, each notch having a narrow closed end and a relatively wider tapered end that is open, the inner surfaces of both substrates bonded together in the region near the narrow closed end of the notch, the inner surfaces of both substrates separated from each other in the region near the wider tapered end of the notch, the inner surfaces diverging outward one from another towards the open end of the notch.

9. A printed circuit board having a dielectic surface, the dielectric surface having at least one edge, and including an antenna, the antenna comprising:

an essentially planar metallic surface formed as a metal coating disposed on said dielectric surface and extending to the edge of the dielectric surface, the metal coating removed in a first essentially linear region to form a coplanar waveguide feed, the metal coating removed in a second region to form a notch having a closed narrow end and a tapered wider end that is open near the edge of the dielectric surface, the coplanar waveguide feed intersecting the notch at a coplanar junction located near the closed narrow end of the notch.

* * * * *